US012447387B2

(12) United States Patent
Shie

(10) Patent No.: US 12,447,387 B2
(45) Date of Patent: Oct. 21, 2025

(54) BALL DETECTION DEVICE

(71) Applicant: Cheng-Yi Shie, Tainan (TW)

(72) Inventor: Cheng-Yi Shie, Tainan (TW)

( * ) Notice: Subject to any disclaimer, the term of this patent is extended or adjusted under 35 U.S.C. 154(b) by 495 days.

(21) Appl. No.: 18/170,687

(22) Filed: Feb. 17, 2023

(65) Prior Publication Data

US 2024/0278096 A1 Aug. 22, 2024

(51) Int. Cl.

| | |
|---|---|
| ***A63B 69/00*** | (2006.01) |
| ***A63B 63/00*** | (2006.01) |
| ***A63B 71/02*** | (2006.01) |
| ***A63B 71/06*** | (2006.01) |

(52) U.S. Cl.

CPC ..... *A63B 63/00* (2013.01); *A63B 71/022* (2013.01); *A63B 71/0619* (2013.01); *A63B 2069/0006* (2013.01); *A63B 2220/13* (2013.01); *A63B 2220/36* (2013.01); *A63B 2220/833* (2013.01)

(58) Field of Classification Search

CPC ... A63B 63/00; A63B 71/022; A63B 71/0619; A63B 2069/0006

USPC ..... 473/454

See application file for complete search history.

(56) References Cited

U.S. PATENT DOCUMENTS

| | | | | |
|---|---|---|---|---|
| 6,551,205 | B1 * | 4/2003 | Koelzer, Jr. | A63B 63/00 473/454 |
| 7,393,291 | B2 * | 7/2008 | Huang | A63B 69/0002 473/456 |
| 7,575,526 | B2 * | 8/2009 | Husband | A63B 69/0002 473/456 |
| 7,805,276 | B1 * | 9/2010 | Byers | H10N 30/302 310/334 |
| 8,001,838 | B2 * | 8/2011 | Roberts | A63B 24/00 73/488 |
| 9,308,426 | B2 * | 4/2016 | Thurman | A63B 43/008 |
| 9,889,361 | B2 * | 2/2018 | Noll | F41J 5/20 |
| 2004/0162166 | A1 * | 8/2004 | Tien | A63B 63/06 473/454 |
| 2022/0233943 | A1 * | 7/2022 | Brant | A63B 24/0003 |
| 2024/0278096 | A1 * | 8/2024 | Shie | A63B 63/00 |
| 2025/0222310 | A1 * | 7/2025 | Evrard | A63B 71/022 |

FOREIGN PATENT DOCUMENTS

CN 219050273 U * 5/2023

* cited by examiner

*Primary Examiner* — Mitra Aryanpour

(74) *Attorney, Agent, or Firm* — Best & Flanagan LLP

(57) ABSTRACT

A ball detection device contains a support rack, a target plate, a sensing module, and a control unit. The support rack includes a fixing portion. The target plate includes nine marking zones, and a respective one marking zone has a passing orifice. The sensing module includes multiple ultrasonic sensors corresponding to the nine marking zones of the target plate, and a respective one ultrasonic sensor is received in the fixing portion and corresponds to the passing orifice, such that when the respective one ultrasonic sensor emits ultrasounds to the respective one marking zone, the ultrasounds emit out of the target plate via the passing orifice, thus sensing a ball hitting position and a ball pitching speed by using the respective one ultrasonic sensor. The control unit is electrically connected with the sensing module and is configured to record and display the ball hitting position and the ball pitching speed.

6 Claims, 4 Drawing Sheets

BALL DETECTION DEVICE

TECHNICAL FIELD

The present invention relates to a ball detection device which is configured to sense a ball hitting position and a ball pitching speed of the ball detection device accurately.

BACKGROUND

A conventional pitching practice device contains a fixed metal rack and a sensing module, wherein the fixed metal rack includes nine grids formed on a tic-tac-toe shape (i.e., three columns×three rows), and a respective one grid has a lid. When pitching a ball to one of the nine grids, the ball hits a lid of the one grid, and the lid is moved or drops to be sensed by the sensing module, thus sensing a ball hitting position. Then, a sensed signal is sent to a control module from the sensing module so that a display of the control module displays the ball hitting position.

However, a ball pitching speed cannot be sensed, thus limiting practice effect. Moreover, the lid has to be fixed on the one grip to cause using inconvenience.

The present invention has arisen to mitigate and/or obviate the afore-described disadvantages.

BRIEF SUMMARY OF THE INVENTION

The primary aspect of the present invention is to provide a ball detection device which is configured to practice pitching a ball, and a ball hitting position and a ball pitching speed of the ball detection device are sensed accurately and are recorded to enhance a practice effect.

To obtain above-mentioned aspect, a ball detection device provided by the present invention contains a support rack, a target plate, a sensing module, and a control unit. The support rack includes a fixing portion. The target plate is fixed in front of the support rack and is spaced from the fixing portion. The target plate includes nine marking zones formed on a front segment of the target plate, and a respective one marking zone has a passing orifice defined therein. The sensing module includes multiple ultrasonic sensors corresponding to the nine marking zones of the target plate, and a respective one ultrasonic sensor is received in the fixing portion and corresponds to the passing orifice of the respective one marking zone, such that when the respective one ultrasonic sensor emits ultrasounds to the respective one marking zone, the ultrasounds emit out of the target plate via the passing orifice, thus sensing a ball hitting position and a ball pitching speed by using the respective one ultrasonic sensor. The control unit is electrically connected with the sensing module and is configured to record and display the ball hitting position and the ball pitching speed.

The support rack includes a connection frame in which the fixing portion is disposed, and the fixing portion has multiple through-orifices. The multiple ultrasonic sensors are received in the fixing portion and correspond to a rear side of one of the multiple marking zones. The respective one ultrasonic sensor corresponds to one of the multiple through-orifices so that the ultrasounds of the respective one ultrasonic sensor emit out of the one through-orifice.

The connection frame includes a stop net mounted thereon and located in front of the target plate. The stop net has multiple meshes so that the ultrasounds of the respective one ultrasonic sensor emit out of the multiple meshes.

The control unit has a circuit board which is connected with a hitting display and a speed display. The hitting display is configured to display a ball hitting position sensed by the sensing module, and the speed display is configured to display a ball pitching speed sensed by the sensing module.

The circuit board further includes a temperature sensor configured to sense a temperature so as to compensate a response time of the ultrasounds

DETAILED DESCRIPTION OF THE INVENTION

Figure 1:
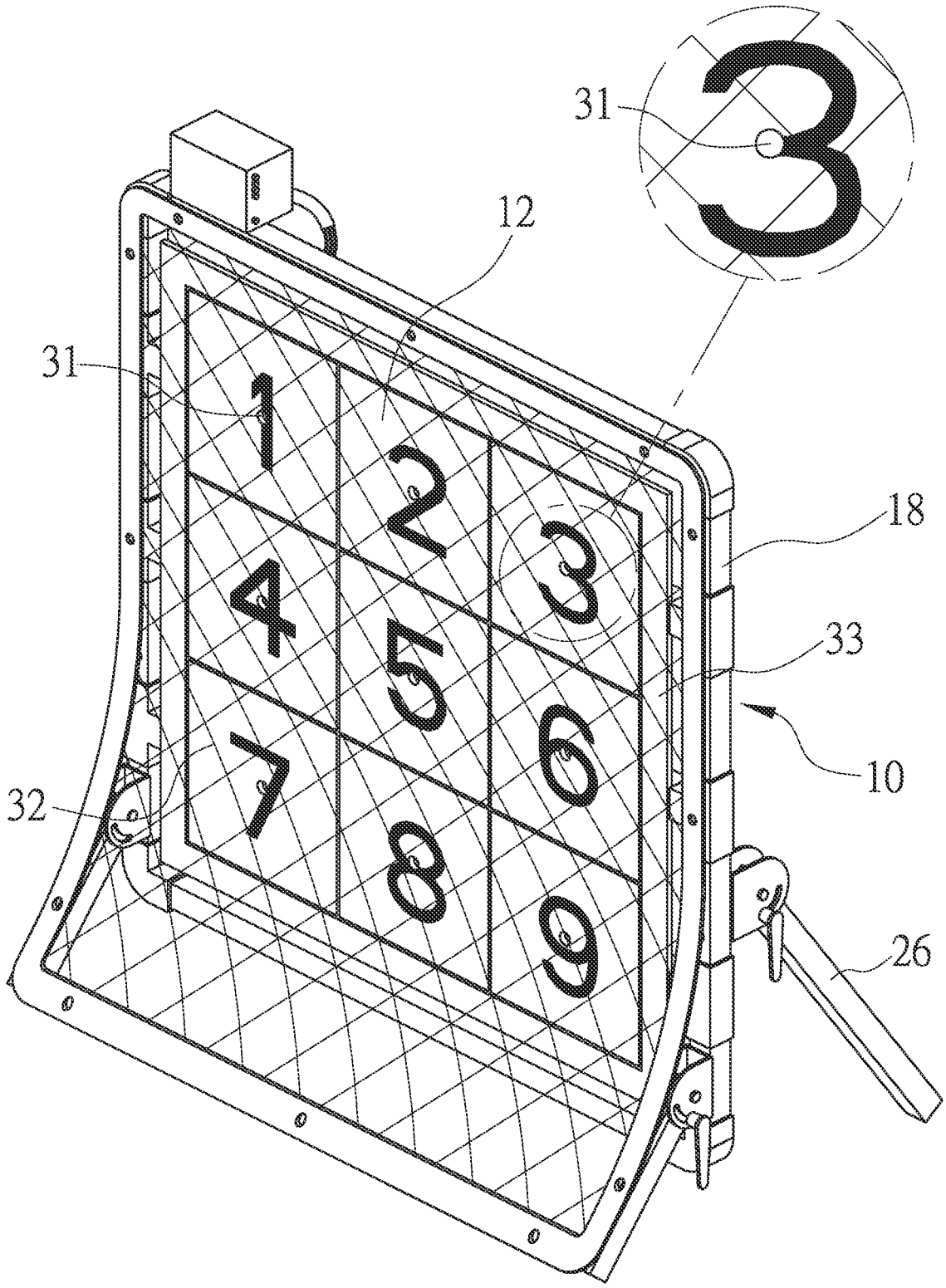
FIG. 1 is a perspective view showing the assembly of a ball detection device according to a preferred embodiment of the present invention.
Figure 2:
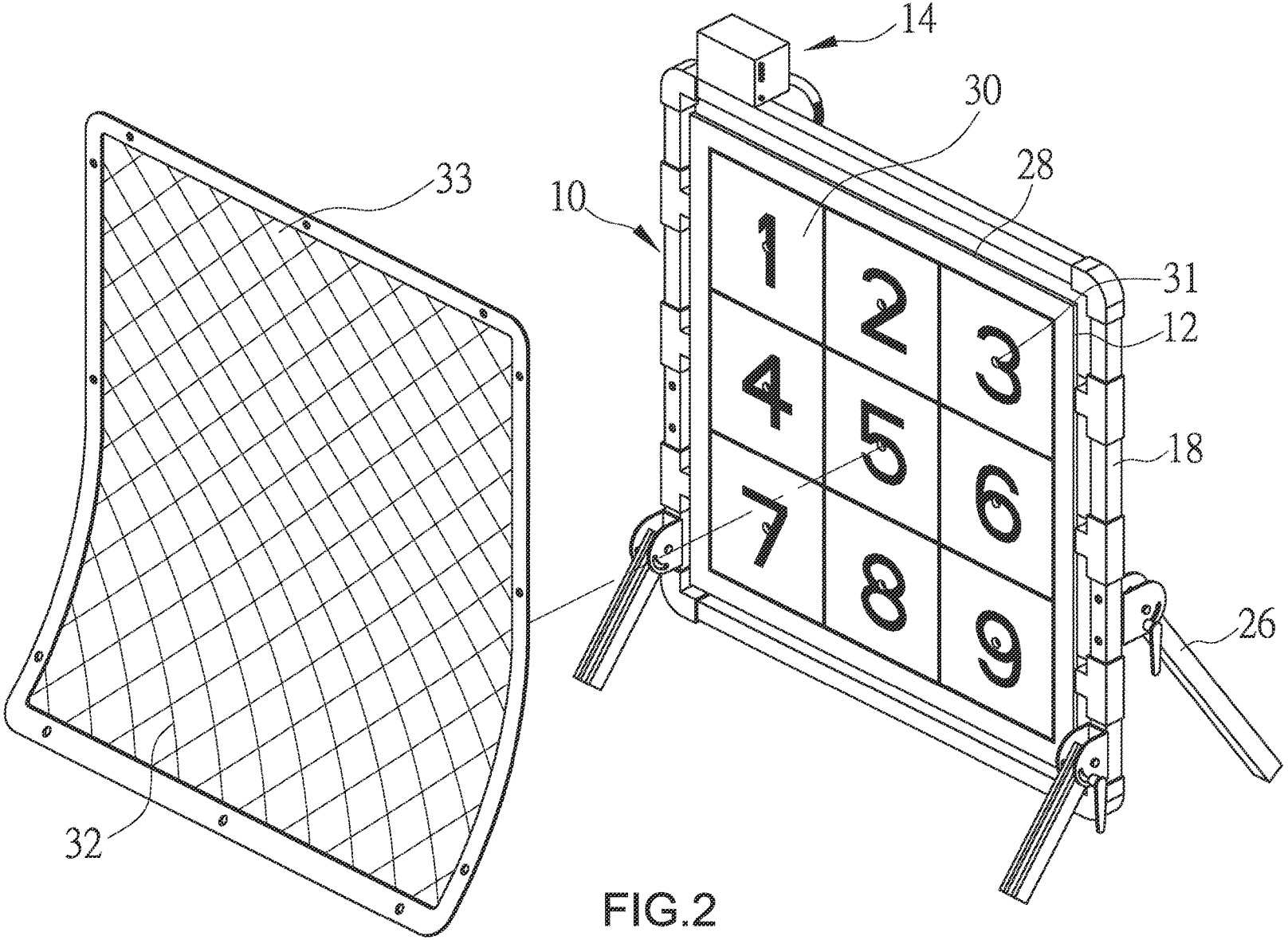
FIG. 2 is a perspective view showing the exploded components of a stop net and a support rack of the ball detection device according to the preferred embodiment of the present invention.
Figure 3:
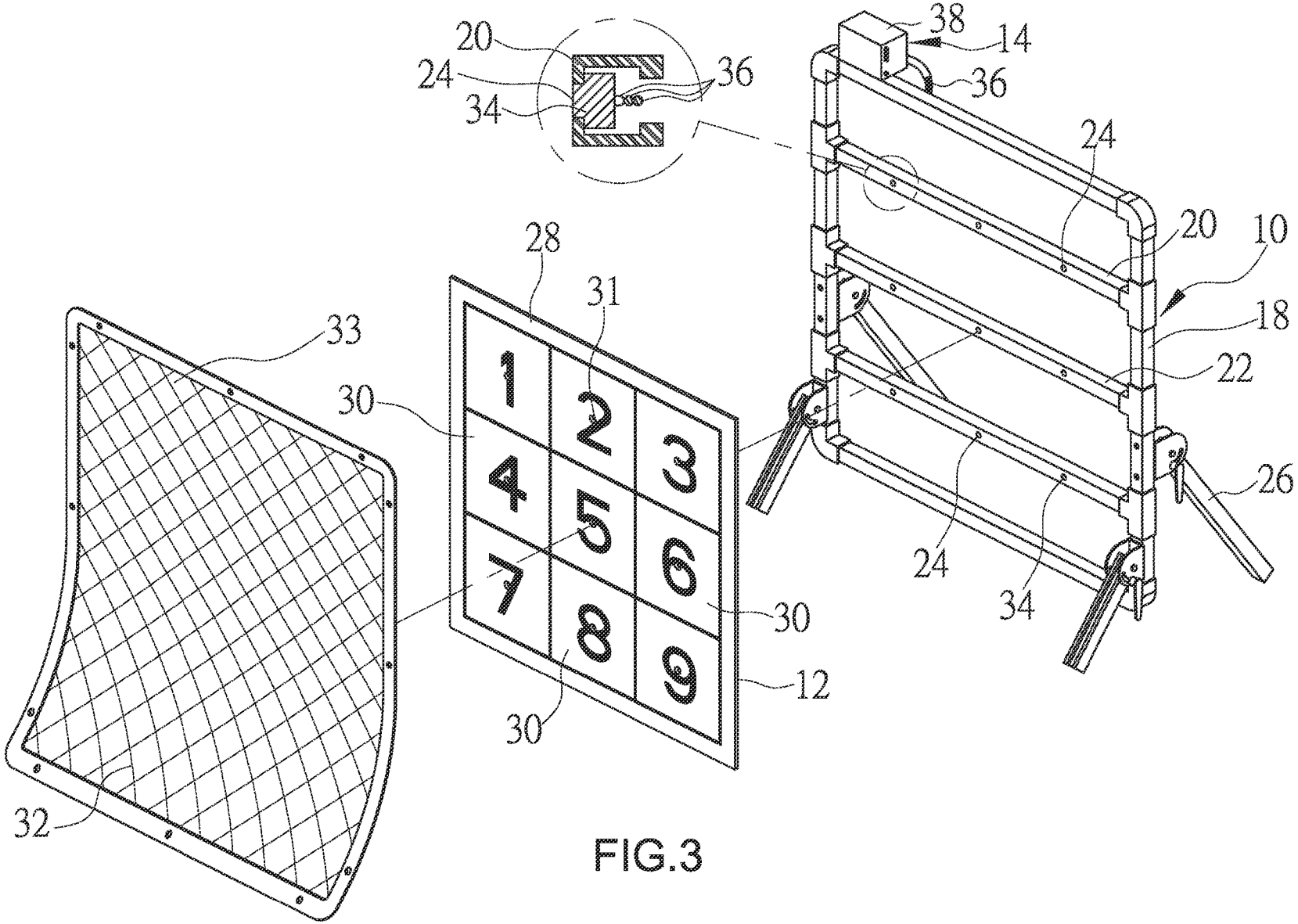
FIG. 3 is a perspective view showing the exploded components of the ball detection device according to the preferred embodiment of the present invention.
Figure 4:
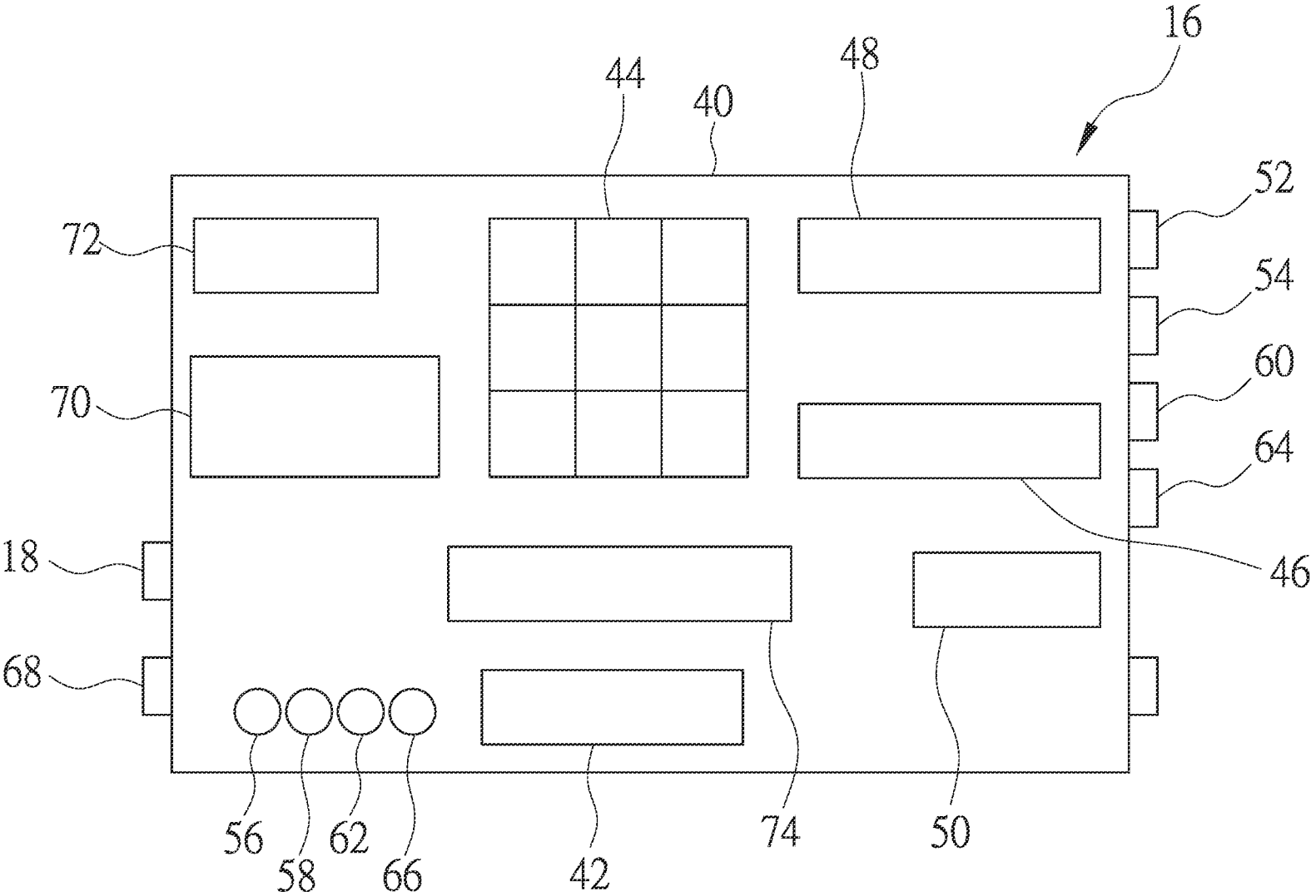
FIG. 4 is a respective view showing the assembly of a control unit of the ball detection device according to the preferred embodiment of the present invention.

With reference to FIGS. 1-4, a ball detection device according to a preferred embodiment of the present invention comprises a support rack 10, a target plate 12, a sensing module 14, and a control unit 16. The support rack 10 includes a connection frame 18 and a fixing portion 20 connected with the connection frame 18. In this embodiment, the fixing portion 20 has multiple spaced posts 22 disposed in the connection frame 18, wherein a respective one post 22 has three through-orifices 24. In this embodiment, the support rack 10 is made of metal rods and a bottom of the support rack 10 is supported by a holder 26. In another embodiment, the support rack 10 is not supported by the holder 26.

The target plate 12 is fixed in front of the support rack 10 and is spaced from the fixing portion 20. The target plate 12 includes multiple marking zones 30 formed on a front segment 28 thereof, wherein a respective one marking zone 30 has at least one passing orifice 31 defined proximate to a center of the respective one marking zone 30, such that a ball is pitched to the respective one marking zone 30 of the target plate 12. In this embodiment, the front segment 28 of the target plate 12 is formed in a tic-tac-toe shape (i.e., three columns×three rows) to define nine marking zones 30 in the front segment 28 and to print Number 1 to Number 9 in the nine marking zones 30. One of the at least one passing orifice 31 of the respective one marking zone 30 corresponds to one of the three through-orifices 24 of the respective one post 22. In this embodiment, the connection frame 18 includes a stop net 32 mounted thereon and located in front of the target plate 12, wherein the stop net 32 has multiple meshes 33 corresponding to the at least one passing orifice 31 of the respective one marking zone 30. The stop net 32 of the connection frame 18 is separated a predetermined distance (such as 5 cm to 15 cm) from the target plate 12 so that a ball is stopped by the stop net 32 when being pitched close to the target plate 12, thus avoiding the ball hitting the target plate 12. In another embodiment, a ball collection bag (not shown) is arranged on a bottom of the stop net 32.

The sensing module 14 is secured on the support rack 10 and includes multiple ultrasonic sensors 34 corresponding to the multiple marking zones 30 of the target plate 12. The sensing module 14 may include nine or eighteen ultrasonic sensors 34. In this embodiment, the fixing portion 20 of the support rack 10 has nine ultrasonic sensors 34, and a respective one ultrasonic sensor 34 is received in the respective one post 22 and corresponds to a rear side of one of the multiple marking zones 30 so that the respective one ultrasonic sensor 34 corresponds to one of the three through-orifices 24, the at least one passing orifice 31, and the multiple meshes 33. Thereby, when the respective one ultrasonic sensor 34 emits ultrasounds to the respective one marking zone 30, the ultrasounds emit out of the one mesh 33 via the one through-orifice 24 and the one passing orifice 31, thus detecting whether sensed data is sent and has a feedback. The multiple ultrasonic sensors 34 are connected to a host computer 38 via a wire 36, and the host computer 38 is electrically connected with the control unit 16 so that the multiple ultrasonic sensors 34 send the sensed data to the control unit 16.

The control unit 16 has a circuit board 40 on which a coupling port 42 is defined so that the sensing module 14 is connected with the coupling port 42, and the control unit 16 receives and records the sensed data of the multiple ultrasonic sensors 34. The circuit board 40 is connected with a hitting display 44 and a speed display 46, wherein the hitting display 44 is configured to display a ball hitting position sensed by the sensing module 14, and the speed display 46 is configured to display a ball pitching speed sensed by the sensing module 14. The circuit board 40 is connected with a chronograph display 48 configured to display a countdown before the user pitches the ball. Furthermore, the hitting display 44, the speed display 46, and the chronograph display 48 has at least one LED (light-emitting diode) lamp configured to display at least one number.

In this embodiment, the circuit board 40 further includes a temperature sensor 50 configured to sense a temperature so as to compensate a response time of the ultrasounds, thus obtaining the ball pitching speed accurately. In addition, the circuit board 40 further includes multiple touch buttons 52, 54, 56, 58 configured to inquire records of the ball hitting position and the ball pitching speed, query stop buttons 60, 62, and restart buttons 64, 66. The touch buttons 52, 54, the query stop button 60, and the restart buttons 64 are configured to control the ball detection device mainly, and the touch buttons 56, 58, the query stop button 62, and the restart button 66 are configured to control the ball detection device remotely. The circuit board 40 includes a power hole 68 configured to input a power supply, two coupling ports 70, 72 configured to connect with a wired control box (not shown) remotely and to correct or update the ball detection device, and a dual in-line package (DIP) switch 74 configured to switch working modes of the ball detection device.

In operation of the ball detection device, the multiple ultrasonic sensors 34 are started. The user stands ahead of the target plate 12 in a predetermined distance and pitches the ball to the one of the multiple marking zones 30. When the ball is pitched to close to the one marking zone 30, the one ultrasonic sensor 34 senses the ball hitting position, the control unit 16 records the ball hitting position, and the hitting display 44 displays the ball hitting position. Then, the sensing module 14 calculates a correlation between a sending time and a receiving time of the ultrasounds and the speed of the ultrasounds, thus sensing the ball pitching speed. Thereafter, the control unit 16 records the ball pitching speed, and the speed display 46 displays the ball pitching speed.

Before the ball hits the target plate 12 after being pitched to the one marking zone 30, the ball is stopped by the stop net 32, thus avoiding the target plate 12 to be hit by the ball.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

The invention claimed is:

1. A ball detection device comprising:

a support rack including a fixing portion;

a target plate fixed in front of the support rack and spaced from the fixing portion, the target plate including nine marking zones formed on a front segment of the target plate, wherein a respective one marking zone has a passing orifice defined therein;

a sensing module including multiple ultrasonic sensors corresponding to the nine marking zones of the target plate, wherein a respective one ultrasonic sensor is received in the fixing portion and corresponds to the passing orifice of the respective one marking zone, such that when the respective one ultrasonic sensor emits ultrasounds to the respective one marking zone, the ultrasounds emit out of the target plate via the passing orifice, thus sensing a ball hitting position and a ball pitching speed by using the respective one ultrasonic sensor; and a control unit electrically connected with the sensing module and configured to record and display the ball hitting position and the ball pitching speed.

2. The ball detection device as claimed in claim 1, wherein the support rack includes a connection frame in which the fixing portion is disposed, with the fixing portion having multiple through-orifices, wherein the multiple ultrasonic sensors are received in the fixing portion and correspond to a rear side of one of the multiple marking zones, wherein the respective one ultrasonic sensor corresponds to one of the multiple through-orifices so that the ultrasounds of the respective one ultrasonic sensor emit out of the one through-orifice.

3. The ball detection device as claimed in claim 1, wherein the connection frame includes a stop net mounted thereon and located in front of the target plate, wherein the stop net has multiple meshes so that the ultrasounds of the respective one ultrasonic sensor emit out of the multiple meshes.

4. The ball detection device as claimed in claim 2, wherein the connection frame includes a stop net mounted thereon and located in front of the target plate, wherein the stop net has multiple meshes so that the ultrasounds of the respective one ultrasonic sensor emit out of the multiple meshes.

5. The ball detection device as claimed in claim 1, wherein the control unit has a circuit board which is connected with a hitting display and a speed display, wherein the hitting display is configured to display a ball hitting position sensed by the sensing module, and the speed display is configured to display a ball pitching speed sensed by the sensing module.

6. The ball detection device as claimed in claim 5, wherein the circuit board further includes a temperature sensor configured to sense a temperature so as to compensate a response time of the ultrasounds.

* * * * *